United States Patent [19]

Poole et al.

[11] Patent Number: 4,903,873

[45] Date of Patent: Feb. 27, 1990

[54] INFANT CARRIER FOR USE IN AN AQUEOUS ENVIRONMENT

[76] Inventors: Allison S. Poole, 518 Gregory Ave., Apt. A309, Weehawken, N.J. 07087; Jodi R. Badagliacca, 70 Riverside Dr., Apt. 6A, New York, N.Y. 10024

[21] Appl. No.: 334,715

[22] Filed: Apr. 7, 1989

[51] Int. Cl.[4] ..... A41D 7/00; A47D 13/02

[52] U.S. Cl. ..... 224/160; 224/158; 224/159; 224/215; 224/262

[58] Field of Search ..... 224/158, 159, 160, 161, 224/209, 214, 215, 216, 257, 259, 262, 258

[56] References Cited

U.S. PATENT DOCUMENTS

| | | | |
|---|---|---|---|
| 2,376,657 | 5/1945 | Chamberlain | 224/159 |
| 3,229,873 | 1/1966 | Hershman | 224/160 |
| 3,871,562 | 3/1975 | Grenier | 324/160 |
| 4,149,687 | 4/1979 | Nunemacher | 224/159 |
| 4,234,229 | 11/1980 | Arnold | 224/160 X |
| 4,436,233 | 3/1984 | Hill et al. | 224/159 |
| 4,467,945 | 8/1984 | Schaapveld | 224/160 |
| 4,579,264 | 4/1986 | Napolitano | 224/160 |
| 4,724,988 | 2/1988 | Tucker | 224/160 |

FOREIGN PATENT DOCUMENTS

| | | | |
|---|---|---|---|
| 2140275 | 11/1984 | United Kingdom | 224/158 |

*Primary Examiner*—Ernest G. Cusick
*Attorney, Agent, or Firm*—Anthony F. Cuoco

[57] ABSTRACT

An infant carrier includes a harness and a pouch removably secured to the harness. The harness and the pouch are of materials suitable for use in an aqueous environment. The removability of the pouch renders the invention adaptable for interchanging pouches in accordance with the size of the infant to be carried as is desirable, and for replacing harnesses and/or pouches for other reasons as the need may arise from time to time.

8 Claims, 2 Drawing Sheets

INFANT CARRIER FOR USE IN AN AQUEOUS ENVIRONMENT

BACKGROUND OF THE INVENTION

This invention relates generally to infant carriers whereby a pouch or the like is strapped to a user and, more particularly, to an infant carrier of the type described which is adaptable to an aqueous environment.

Carriers for infants are well known in the art and generally include a pouch arrangement for supporting the infant and a harness or strap arrangement secured to the pouch arrangement for supporting same on a user.

The applicant is aware of the following U.S. Patents in Class 224, Subclasses 160 and 161, which disclose infant carriers as described. U.S. Pat. No. 2,411,331 discloses an arrangement which protects the infant throughout the larger portion of its body while it is held and carried. U.S. Pat. No. 3,575,326 discloses an infant carrier in a particular formation including special pockets for infant accessories and a flexible wide strap that incorporates internal cushioning for both the infant's seat and the shoulder of the person carrying the infant. U.S. Pat. No. 3,780,919 discloses an infant carrier including reinforcing straps so connected to a pouch and to one another as to permit secure but adjustable suspension either from the front or back of the user. U.S. Pat. No. 3,871,562 discloses an infant carrier conveniently attached to a user and adjusted by virtue of its attachment to provide a secure support for the infant. U.S. Pat. No. 4,166,558 discloses an infant carrier specifically in which the infant is supported in a selected position at the front of the person carrying the infant. U.S. Pat. No. 4,428,514 discloses an infant carrier useable for carrying an infant in a variety of different positions.

None of the infant carriers described above or others in the prior art are adaptable to an aqueous environment. Indeed, their construction and material precludes use in such an environment.

Moreover, the prior art infant carriers invariably teach an integral harness and pouch arrangement. Thus, it has not been possible to remove or separate the pouch from the harness as may be desirable when one or the other wears out or must be otherwise replaced.

As far as the adaptability of an infant carrier to an aqueous environment is concerned, modern mothers find it convenient to use such a carrier for carrying an infant in a shower or a swimming pool, or for like purposes. The feature of separating or removing the pouch from the harness has been found advantageous for accommodating different size pouches for different size infants, or as the infant grows from one size pouch to a larger size pouch, as is inevitably the case.

Accordingly, the infant carrier herein disclosed is an improvement over the prior art infant carriers in that it provides a non-integral or separable pouch and harness arrangement so that either the pouch or the harness is interchangeable or replaceable as the case may be. Further, the arrangement of the present invention in its configuration and construction is such that it is most suitable for use in an aqueous environment and therefore solves a modern day need.

SUMMARY OF THE INVENTION

This invention contemplates an infant carrier including a harness and a pouch for use in an aqueous environment. The harness and the pouch are made of suitable strong, quick-dry, soft, flexible materials such as textiles, and the pouch is of a mesh construction so as to enhance its suitability for the aqueous environment. The harness which supports the pouch about the torso of the user and the pouch itself are in a nonintegral arrangement. That is to say, the pouch and harness are separably secured to each other via buckles or the like. This feature of the invention provides pouch and harness interchangeability as is desirable when one or the other must be replaced as the case may be, and particularly permits the use of different size pouches in accordance with the size of the infant. The buckles serve the further purpose of rendering the harness adjustable to accommodate the girth of the user and to vary the height at which the user desires to carry the pouch. The pouch is pleated at its crotch area to prevent "bundling" of material thereat, which would otherwise occur and be uncomfortable for the infant.

DETAILED DESCRIPTION OF THE INVENTION

Figure 1:
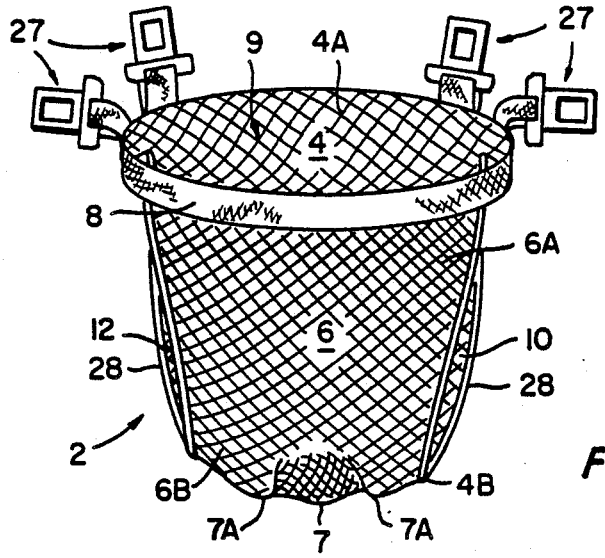
FIG. 1 is a pictorial representation showing the pouch of the disclosed infant carrier.

With reference first to FIG. 1, the pouch of the disclosed infant carrier is designated by the numeral 2. Pouch 2 includes a pair of panels 4 and 6. Panels 4 and 6 are of a suitable commercially available strong, quick-dry, soft, flexible, textile mesh material. Panels 4 and 6 are substantially wider at their tops 4A and 6A thereof then they are at their bottoms 4B and 6B.

A continuous belt-like member 8 is made of a suitable strong, quick-dry, soft, flexible, textile webbing material. Panel 4 is secured as by sewing or the like at its upper portion 4A to the inside of belt member 8 on one side thereof. Panel 6 is likewise secured at its upper portion 6A to the inside of belt member 8 on the opposite side thereof. Panels 4 and 6 are joined as by sewing or the like at their bottom portions 4B and 6B.

Figure 5:
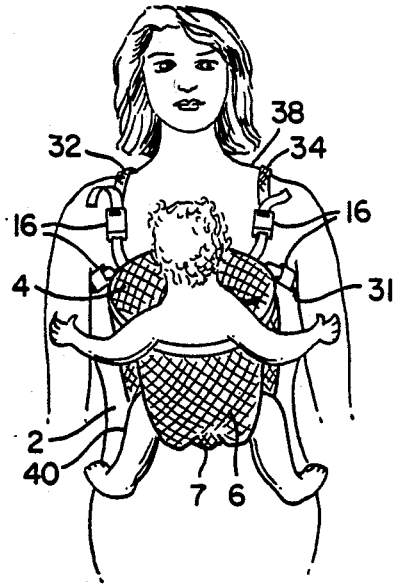
FIG. 5 is a front plan view showing the infant carrier of the invention supported by a user and further showing an infant positioned in the pouch facing a user as preferred.

Thus, pouch 2 is formed so as to have an opening 9 at its top for receiving an infant to be carried in the pouch, and to have side openings 10 and 12 through which the infant's legs extend when the infant is supported in the pouch, as best shown in FIG. 5. Joined bottom portions 4B and 6B of panels 4 and 6 form a crotch portion 7 of the pouch.

Figure 3:
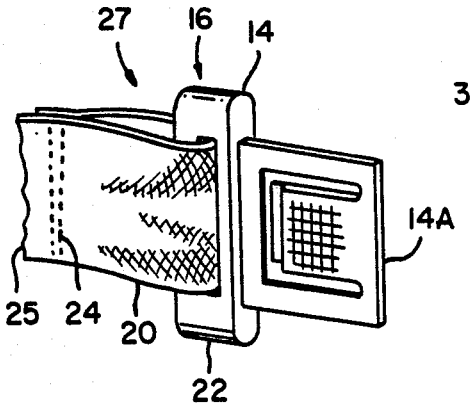
FIG. 3 is a pictorial representation showing the male portion of a buckle of a type used with the invention.
Figure 4:
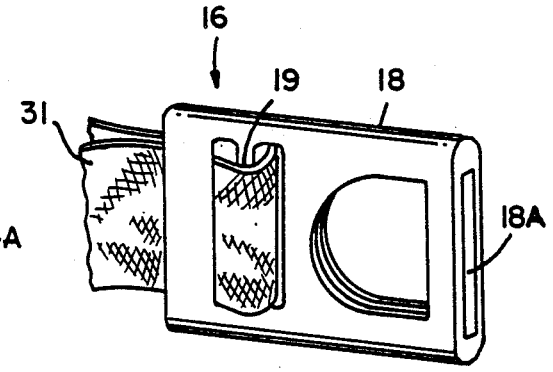
FIG. 4 is a pictorial representation showing the female portion of the buckle.

A male portion 14 of a buckle 16 is shown in FIG. 3 and a female portion 18 of buckle 16 is shown in FIG. 4. A strip of webbing designated by the numeral 20 and of a material such as that of belt member 8 is looped around a slotted portion 22 of male buckle portion 14. The ends of webbing strip 20 are joined as by sewing at 24 and a tail 25 extends from the sewn joint to provide a looped male buckle portion assembly 27.

Thus, four such assemblies 27 are secured to belt member 8 via tails 25 which are sewn to the belt member. Two of the assemblies are secured to the outer surface of belt member 8 in spaced relation near the opposite ends of wide portion 4A of panel 4 so as to extend substantially normal to the belt member, and the other two assemblies 27 are secured to belt member 8 near the opposite ends of portion 4A of panel member 4 so as to extend substantially parallel to belt member 8 as best shown in FIG. 1.

In order to provide a finished pouch, the open side ends 10 and 12 thereof have sewn thereto a suitable bias tape 28 also best shown in FIG. 1.

Figure 7:
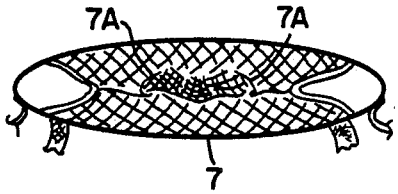
FIG. 7 is a pictorial representation showing the crotch area of the pouch, and particularly showing a pleated section thereof.

With reference to FIGS. 1 and 7, crotch portion 7 of pouch 2 is pleated or gathered on the underside thereof as at 7A so as to provide a "form-fit" and to prevent "bundling" of excess material which would otherwise occur and be uncomfortable to the infant when supported in the pouch and resting on the crotch portion.

Figure 2:
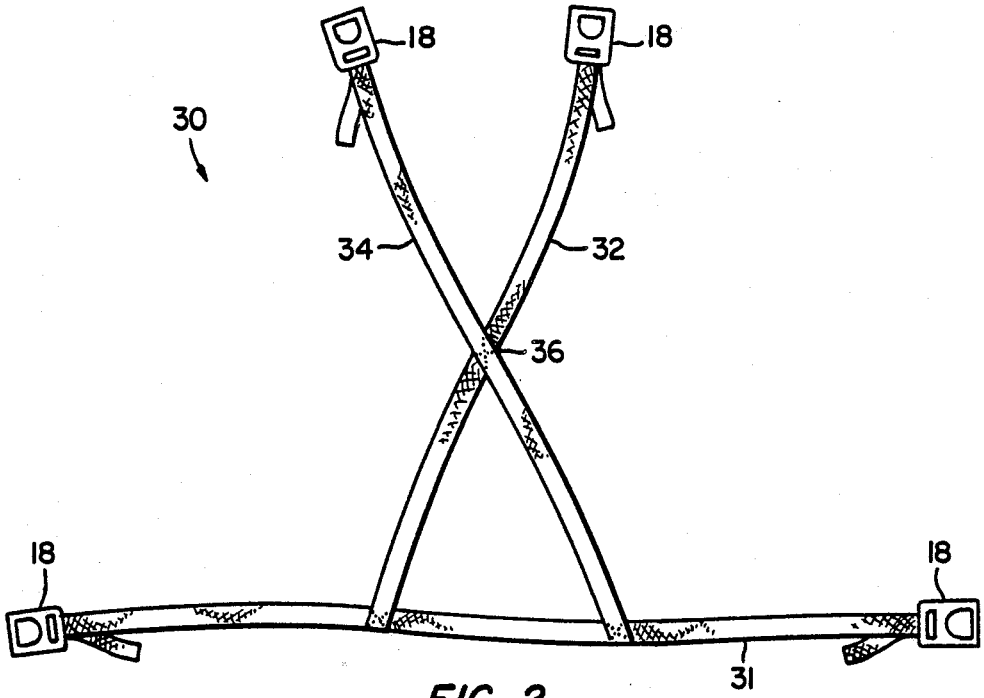
FIG. 2 is a pictorial representation showing the harness of the disclosed infant carrier.

With reference to FIG. 2, a harness is designated generally by the numeral 30. Harness 30 is of a material such as that described for belt member 8 of pouch 2. Harness 30 includes a belt member 31 and shoulder members 32 and 34 joined at one of their ends in spaced relation as by sewing to the center section of belt member 31, and extending angularly therefrom so as to cross as at 36 where the shoulder members are joined together as by sewing.

Each of the ends of belt member 31 is secured to a female portion 18 of a buckle 16 as shown in FIG. 4. In this regard it will be understood that female buckle portion 18 includes a gripper 19 which releasably grips the end of belt member 31 when said end is inserted through a slot in the female buckle portion. It will be understood that this provides for adjustment of the circumference of the belt member when said member is disposed around the torso of a user.

Likewise, each of the free ends of shoulder members 34 and 32 carry female buckle portions 18, and the shoulder members are likewise adjustable as aforenoted.

In regard to buckles 16, it will be understood that a variety of buckles of a suitable plastic material or the like so as to be useable in an aqueous environment and otherwise serving the purposes described are commercially available. The particular buckle herein described is marketed by Streamline Industries, Inc., Garden City, N.Y., under their trade designation C642. Only as much of the structural configuration of the buckle as is necessary to describe its function with the invention has been herein described and shown.

Figure 6:
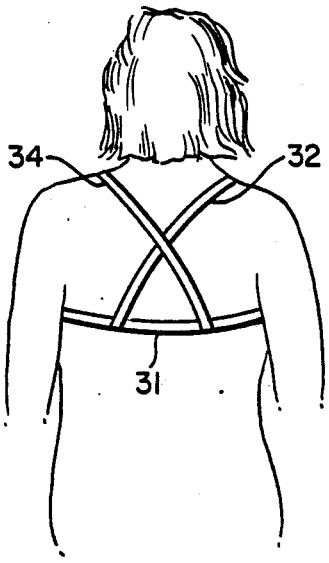
FIG. 6 is a rear plan view showing the harness of the infant carrier disposed on the user.

The use of the invention is best described with reference to FIGS. 5 and 6. When it is desired to carry an infant 40 in the disclosed infant carrier, belt member 31 of harness 30 is disposed around the upper torso of a user 38 and shoulder portions 32 and 34 are disposed over the shoulders of the user. Male buckle portions 14 of buckles 16 disposed on belt member 8 substantially parallel thereto (FIG. 1) are snapped via tabs 14A into slots 18A of female buckle portions 18 on the ends of belt member 31 so as to support pouch 2 around the upper torso of the user. Male buckle portions 14 disposed on belt member 8 substantially normal thereto are likewise snapped into the female buckle portions 18 on shoulder straps 32 and 34 to support pouch 2 over the shoulders of user 38. In this connection it will be understood that panel 4 of pouch 2 is adjacent the upper torso of the user when the pouch is supported on the user as shown in FIG. 5, and infant 40 is carried facing user 38 as shown in FIG. 5 or facing away from the user, as may be desired.

With further reference to FIG. 5, it will be seen that with pouch 2 secured to harness 30 via buckles 16 as aforenoted, infant 40 is disposed through open end 9 of the pouch and is supported therein so as to rest on the crotch portion thereof, with the infant's legs extending through side openings 10 and 12. It will be seen that harness 30 is adjustable via buckles 16 around the upper torso of the user to accommodate the user's girth and about the shoulders of the user to accommodate the height at which it is desired to carry the infant.

In accordance with the aforegoing description of the invention, it will be understood that the desirability of providing an infant carrier suitable for carrying an infant in an aqueous environment has been achieved. The carrier includes a harness and a pouch releasably or removably attached to each other so as to be replaceable or interchangeable, as the case may be. The harness is adjustably supported around the upper torso and the shoulders of the user. All materials used in the invention are such so as to enhance the suitability of the invention for use in an aqueous environment.

With the above description of the invention in mind reference is made to the claims appended hereto for a definition of the scope of the invention.

What is claimed is:

1. An infant carrier for use in an aqueous environment, comprising:

a pouch of a soft, flexible textile material suitable for use in an aqueous environment;

the pouch including an open top for receiving an infant to be supported in the pouch, opposite open sides through which the infant's legs extend, a crotch portion upon which the infant rests, a continuous belt-like member of a webbing material, first and second panels of a mesh material, each of which has a top and a bottom, and the first panel being secured at its top to the belt-like member and the second panel being secured at its top to the belt-like member in opposite spaced relation to the first panel, and the bottoms of the first and second panels being secured together, whereby the pouch is provided with the open top, the opposite open sides and the crotch portion;

a harness of a soft, flexible textile material suitable for use in an aqueous environment;

the harness including a belt and a pair of shoulder straps, the belt having opposite free ends and each of the pair of shoulder straps having one end secured to the belt and an opposite free end;

a buckle for each of the belt and shoulder strap free ends, each of the buckles being of a material suitable for use in an aqueous environment;

each of the buckles including a first member arranged with a corresponding free end and a second member carried by the pouch;

the first and second members being engageable for joining the pouch and the harness whereby the belt is disposed around the upper torso of a user and the shoulder straps are disposed over the user's shoulders for supporting the pouch in front of the user, and being disengageable whereby the pouch and harness are separable from each other; and each of the first buckle members arranged with its corresponding free end so that the belt length is adjustable to accommodate the girth of the user and the length of the shoulder straps is adjustable to accommodate the height at which it is desired to support the pouch.

2. An infant carrier as described by claim 1, including:

one of the first and second panels being adjacent the upper torso of the user when the pouch is supported in front of the user;

a first of the second buckle members carried by the belt-like member near one end of the top of the one panel so as to extend substantially normal to the belt-like member;

a second of the second buckle members carried by the belt-like member near the opposite end of the top of the one panel so as to extend substantially normal to the belt-like member;

a third of the second buckle members carried by the belt-like member near the one panel end so as to extend substantially parallel to the belt-like member; and a fourth of the second buckle members carried by the belt-like member near the opposite panel end so as to extend substantially parallel to the belt-like member.

3. An infant carrier as described by claim 1, including:

the crotch portion being pleated to gather excess material for preventing bundling thereof and for providing form-fitting, whereby the comfort of the infant is enhanced when resting on the crotch portion.

4. An infant carrier as described by claim 1, wherein:

one of the pair of harness shoulder straps is secured at its one end to the belt near the center thereof;

the other of the pair of harness shoulder straps is secured at its one end to the belt near the center thereof and in spaced relation to the one end of the one shoulder strap;

the one and the other of the shoulder straps extending angularly from the belt so as to cross; and said shoulder straps being secured to each other where they cross.

5. An infant carrier for use in an aqueous environment, comprising:

a pouch of a soft, flexible textile material suitable for use in an aqueous environment, said pouch for supporting an infant and including a continuous belt-like member of a webbing material, first and second panels of a mesh material each of which has a top and a bottom, and the first and second panels secured at their tops to the belt-like member in opposite spaced relation to each other and secured at their bottoms to each other, whereby the pouch has an open top, opposite open sides and a crotch portion;

a harness of a soft, flexible textile material suitable for use in an aqueous environment for supporting the pouch around the upper torso and the shoulders of a user;

means of a material suitable for use in an aqueous environment arranged with the pouch and the harness for removably joining said pouch and said harness; and means of a material suitable for use in an aqueous environment for adjusting the harness to accommodate the girth of the user's upper torso and the height from the shoulders at which it is desired to support the pouch.

6. An infant carrier as described by claim 5, including:

the crotch portion being pleated to gather excess material for preventing bundling thereof and for providing form-fitting, whereby the comfort of the infant is enhanced when supported in the pouch.

7. An infant carrier as described by claim 5, wherein:

one of the first and second panels is adjacent the upper torso of the user when the pouch is supported by the harness; and the means arranged with the pouch and the harness for removably joining said pouch and said harness arranged with the one panel.

8. An infant carrier as described by claim 5, wherein the harness is of a webbing material and includes:

a belt and a pair of shoulder straps, the belt having opposite free ends and each of the shoulder straps have one end secured to the belt and an opposite free end;

the means arranged with the pouch and the harness for removably joining said pouch and said harness arranged with the free ends of the belt and the straps; and the means for adjusting the harness to accommodate the girth of the user's upper torso and the height from the shoulders at which it is desired to support the pouch arranged with the free ends of the belt and the straps.

* * * * *